US005564579A

United States Patent [19]

Pynenburg et al.

[11] Patent Number: 5,564,579

[45] Date of Patent: Oct. 15, 1996

[54] APPARATUS FOR CONSTRUCTING A GONDOLA CANOPY

[75] Inventors: Adrian Pynenburg; Martin Cross, both of Brantford, Canada

[73] Assignee: Screen Print Industries, Inc., Brantford, Canada

[21] Appl. No.: 285,508

[22] Filed: Aug. 3, 1994

[51] Int. Cl.[6] ..... G09F 7/20; A47F 5/00

[52] U.S. Cl. ..... 211/189; 52/73; 211/190; 211/193; 211/175; 211/187

[58] Field of Search ..... 211/189, 187, 211/190, 193, 175; 248/225.1, 287; 52/73, 74, 713

[56] References Cited

U.S. PATENT DOCUMENTS

| | | | |
|---|---|---|---|
| 4,126,230 | 11/1978 | Tyson et al. | 211/189 X |
| 4,531,331 | 7/1985 | Itagaki | 211/189 X |
| 4,805,783 | 2/1989 | Mayer | 211/189 X |
| 5,150,484 | 9/1992 | Whitten Jr. | 211/189 X |
| 5,437,116 | 8/1995 | Hardy | 211/189 X |

*Primary Examiner*—Michael Safavi
*Assistant Examiner*—Robert J. Canfield
*Attorney, Agent, or Firm*—Howard J. Greenwald

[57] ABSTRACT

An apparatus for constructing a gondola canopy comprising an outrigger arm with means for adjusting the length of such arm, an adapting plate attached to the outrigger arm, a fascia board removably attached to the adapting plate, means for removably attaching the adapting plate to the fascia board, and means for adjusting the height of the fascia board.

19 Claims, 14 Drawing Sheets

FIG. 7
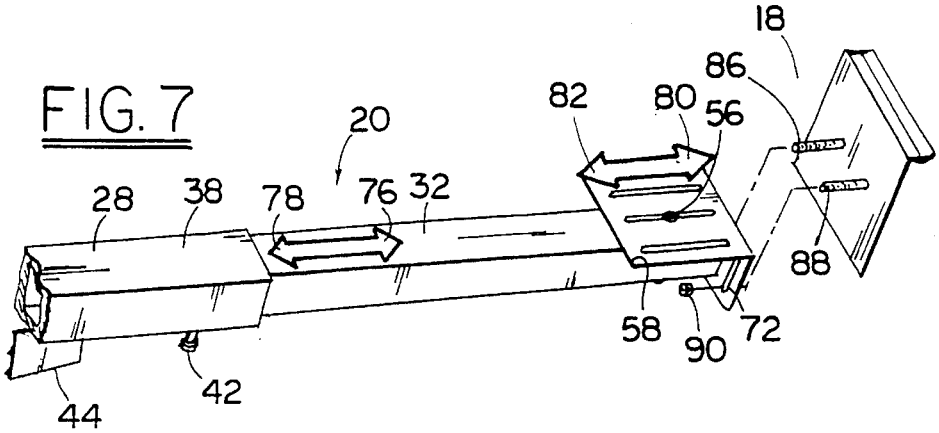
FIG. 8
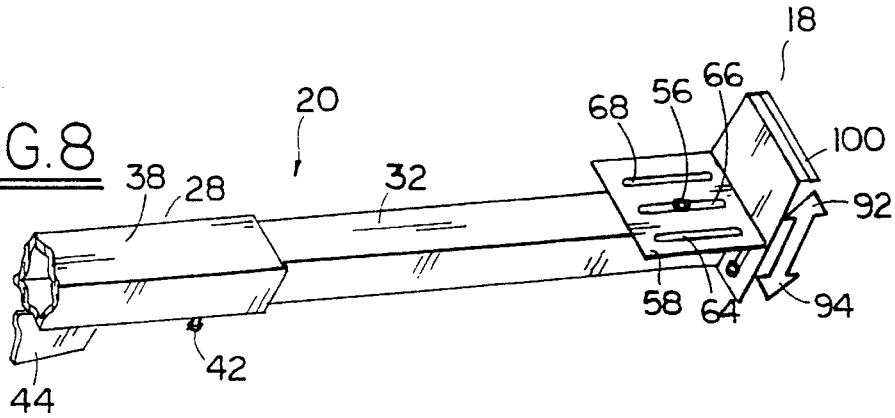
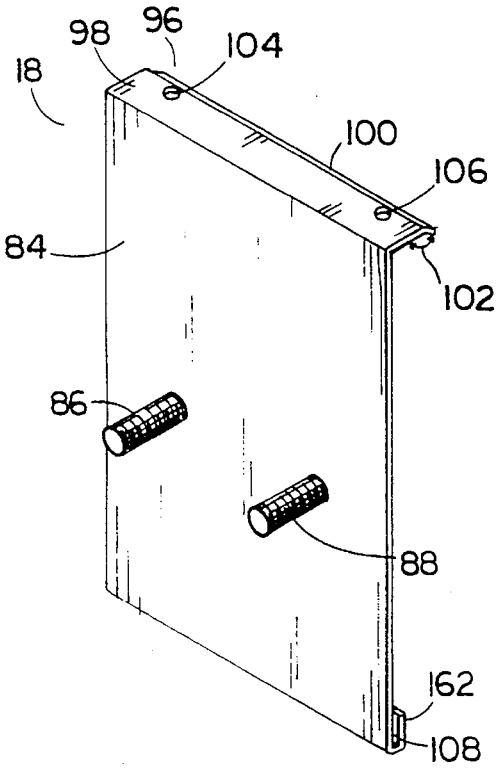
FIG. 9

FIG. 24
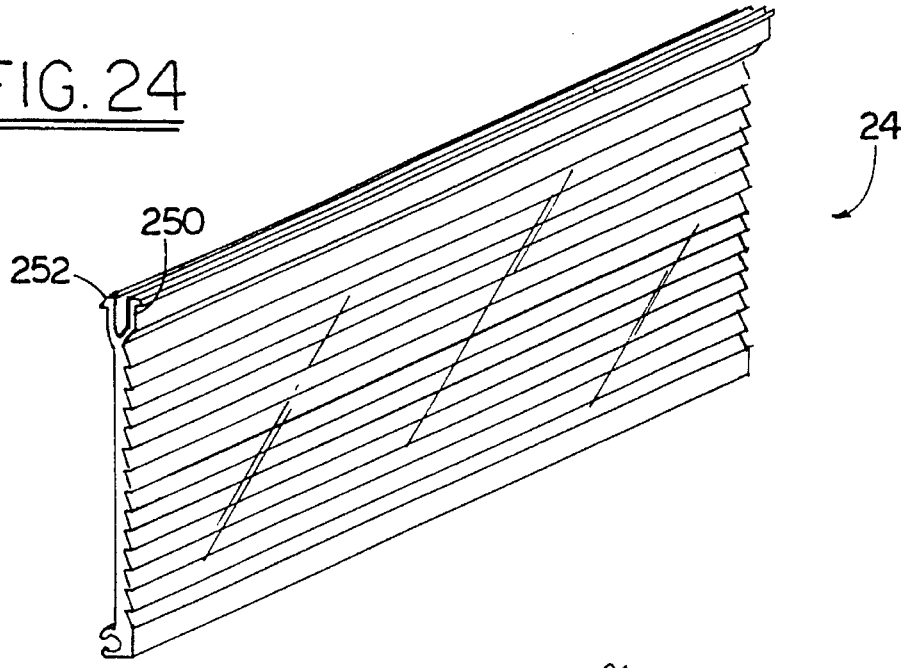
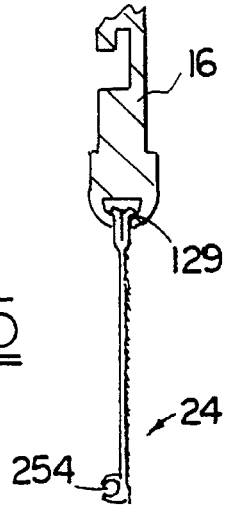
FIG. 25
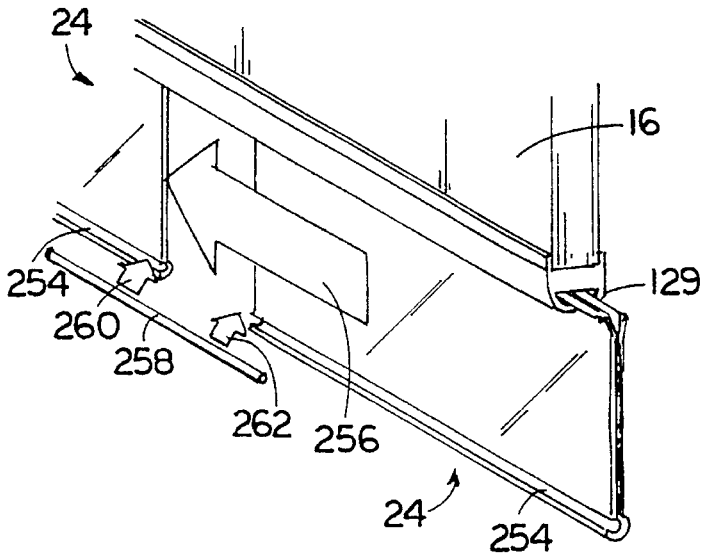
FIG. 26

APPARATUS FOR CONSTRUCTING A GONDOLA CANOPY

FIELD OF THE INVENTION

An apparatus for constructing a gondola canopy which allows one to readily construct a gondola canopy in different heights, lengths, and configurations.

BACKGROUND OF THE INVENTION

Gondola shelving is commonly used in many stores to exhibit and merchandise product. This type of gondola display unit is well known to and widely described in the prior art. See, by way of illustration, U.S. Pat. Nos. 5,096,074, 5,022,541, 5,014,862, 4,960,210, 4,919,282, 4,872,567, 4,785,946, 4,068,855, and 3,830,374. The disclosure of each of these patents is hereby incorporated by reference into this specification.

The prior art gondola canopy devices frequently require a substantial amount of labor to construct. They are frequently made of either wood or metal, and thus they are usually rather heavy.

When the components of the prior gondola canopy devices are made of metal, it is difficult and expensive to produce gondola canopies with complicated shapes.

Different problems are presented when the components of the prior gondola canopy devices are made of wood. Wood tends to warp because of moisture absorption, and thus gondola canopies made from wood do not retain their initial shape over time. Because of such warping, the seams joining such wood components often tend to open.

It is an object of this invention to produce a device adapted to produce a gondola canopy which will not undergo warping or change of shape over time.

It is another object of this invention to produce a device adapted to produce a gondola canopy which is relatively lightweight.

It is another object of this invention to produce a device adapted to produce a gondola canopy which will require substantially less time and labor to install than do prior art gondola canopies.

It is another object of this invention to produce a device adapted to produce a gondola canopy whose height and/or length and/or depth and/or configuration can be readily modified during construction.

It is another object of this invention to produce a device adapted to produce a gondola canopy which is attractive.

It is another object of this invention to produce a device adapted to produce a gondola canopy which is relatively strong.

It is another object of this invention to produce a device adapted to produce a gondola canopy which is capable of suspending merchandise from at least one of its faces.

It is another object of this invention to produce a device adapted to produce a gondola canopy can be made in lengths of up to and greater than 36 feet.

It is another object of this invention to produce a device adapted to produce gondola canopy which is capable of supporting one or more light fixtures and can readily be installed in an economical manner.

It is another object of this invention to produce a device adapted to produce a gondola canopy whose configuration can readily be changed in response to changing conditions.

SUMMARY OF THE INVENTION

In accordance with this invention, there is provided an apparatus for constructing a gondola canopy comprising an outrigger arm with means for adjusting the length of such arm, an adapting plate attached to the outrigger arm, a fascia board removably attached to the adapting plate, means for removably attaching the adapting plate to the fascia board, and means for adjusting the height of the fascia board.

BRIEF DESCRIPTION OF THE DRAWINGS

The present invention will be more fully understood by reference to the following detailed description thereof, when read in conjunction with the attached drawings, wherein like reference numerals refer to like elements, and wherein:

FIG. 7 is a partial exploded view illustrating how the outrigger mounting bracket of FIG. 5 can be connected to the outrigger of FIG. 3 and, thereafter, how a cornice outrigger plate may be attached to the outrigger mounting bracket;

FIG. 8 is a partial exploded view illustrating how the height of the cornice outrigger plate of FIG. 7 may be adjusted;

FIG. 9 is a front view of the cornice outrigger plate of FIG. 7;

FIG. 24 is a perspective view of a diffuser panel;

FIG. 25 is a side view of a cornice panel/diffuser panel assembly, illustrating how the diffuser panel of FIG. 24 may be joined to the cornice panel of FIG. 15;

FIG. 26 is a perspective view of a cornice panel/diffuser panel assembly, illustrating how adjacent diffuser panels may be joined end to end;

DESCRIPTION OF THE PREFERRED EMBODIMENTS

Figure 1:
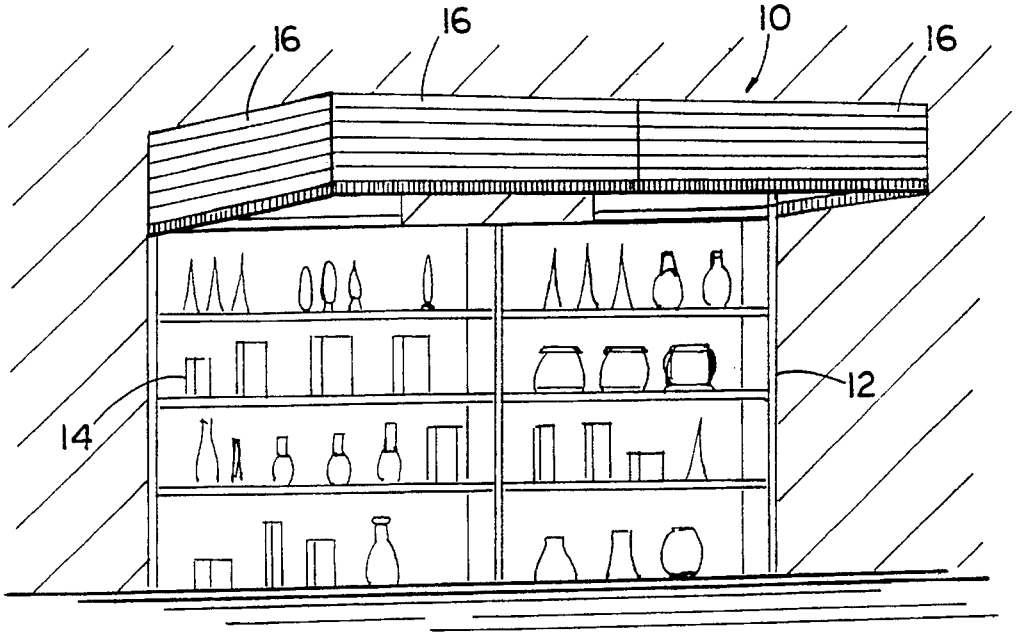
FIG. 1 is a perspective view of a gondola canopy made in accordance with the process of this invention mounted on a typical gondola shelving device.

FIG. 1 is a perspective view of a gondola canopy 10 mounted on gondola shelving 12 which contains merchandise 14. The preferred gondola canopy device 10 is illustrated in FIG. 2, which is an exploded view of said structure.

Figure 2:
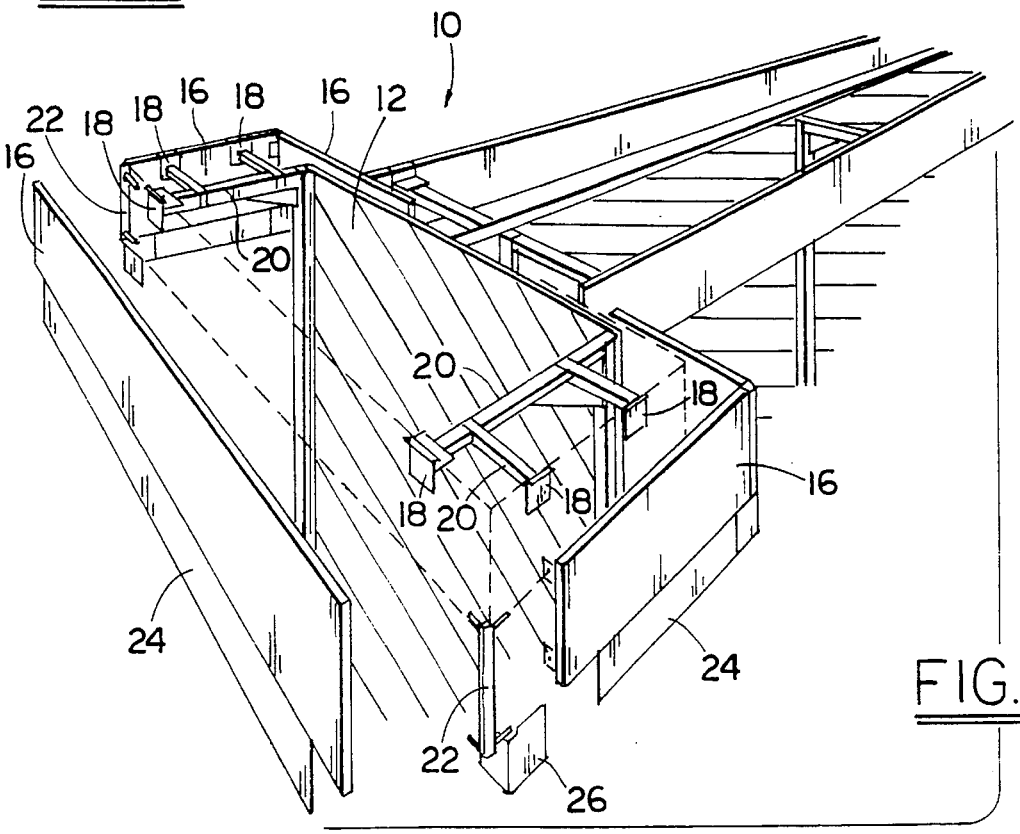
FIG. 2 is an exploded perspective view of a gondola canopy structure made in accordance with the process of the invention.

Referring to FIG. 2, it will be seen that gondola canopy 10 is comprised of a multiplicity of cornice panels 16 also known as fascia boards, each of which is attached to at least one cornice outrigger plate 18 by means described in greater detail elsewhere in this specification. The cornice outrigger plates 18 are, in turn, attached to outriggers 20 which, in turn, may be secured to gondola shelving unit 12.

In the preferred embodiment illustrated in FIG. 2, various cornice panels 16 may be disposed at substantially right angles to each other and joined to each other by means of cornice corner inserts 22. Furthermore, in this embodiment, diffuser panels 24 may be secured to the bottoms of cornice panels 16. To complete the assembly 10, end diffuser panels may be joined to the one of the cornice corner inserts 22.

Figure 3:
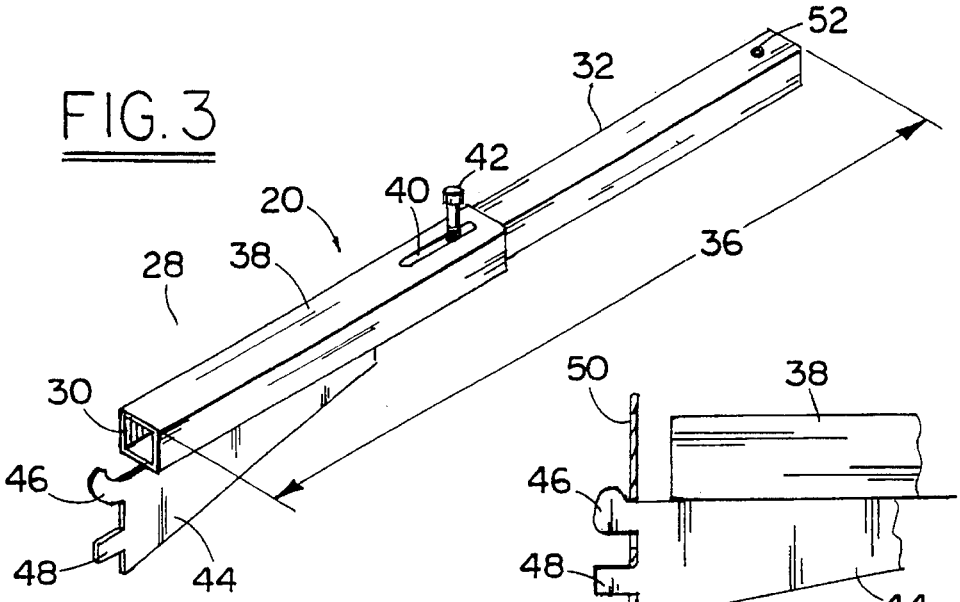
FIG. 3 is a perspective view of an adjustable outrigger which may be attached to a gondola shelving frame.
Figure 4:
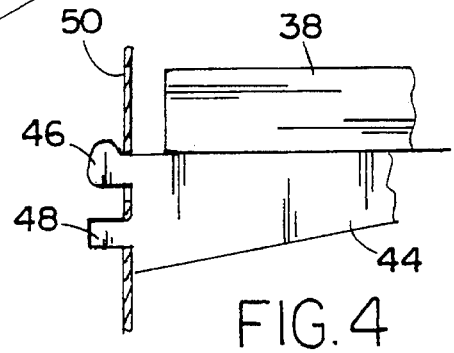
FIG. 4 is a partial side view of the outrigger of FIG. 3 connected to a gondola shelving frame.

FIG. 3 is a perspective view of one preferred adjustable outrigger 20 which may be used in the apparatus 10 of this invention. As used in this specification, the term outrigger refers to a projecting frame member extending laterally beyond the main structure of an assembly (such as a shelving assembly) to support an extending part. Outrigger members are well known to those skilled in the art and are described, e.g., in U.S. Pat. Nos. 5,102,266, 5,083,722, 5,029,437, 4,999,862, 4,936,390, 4,858,948, 4,836,517, 4,828,208, and the like. The entire description of each of these United States patents is hereby incorporated by reference into this specification.

The types of outriggers 20 illustrated in FIG. 3 are readily commercially available. Thus, by way of illustration and not limitation, one may obtain an "adjustable wood canopy bracket" structure from Lozier Store Fixtures Company, P.O. Box 249, Omaha, Nebr. These brackets are, according to the Lozier catalog, "Adjustable arm brackets for mounting Wood Canopy Fascia. Arms adjust from 16" to 26" or 25" to 35" deep." Thus, one may purchase "Upright-Mount (End)" slotted brackets as catalog numbers CA1551 or CA1552 from Lozier; or, alternatively, one may purchase "Upright-Mount" (Center) slotted brackets as catalog numbers CA1541 or CA1542 from Lozier. Wall mount brackets adapted to be directly mounted to a wall may also be purchased from Lozier as catalog numbers CA1972 or CA1971.

Referring to FIG. 3, a perspective view of a preferred adjustable outrigger 20 is presented. It will be seen that outrigger 20 is preferably comprised of tube 28 containing an orifice 30, and an adjustable arm 32 adapted to be slidably disposed within orifice 30. In the preferred embodiment illustrated in FIG. 3, tube 28 has a substantially square shape.

In one preferred embodiment, illustrated in FIG. 3, adjustable arm 32 is a substantially U-shaped structure comprised of right side 34, top side 36, and a left side (not shown in FIG. 3); in this embodiment, the sides of the adjustable arm 32 preferably form a right angle with each adjacent arm.

Figure 5:
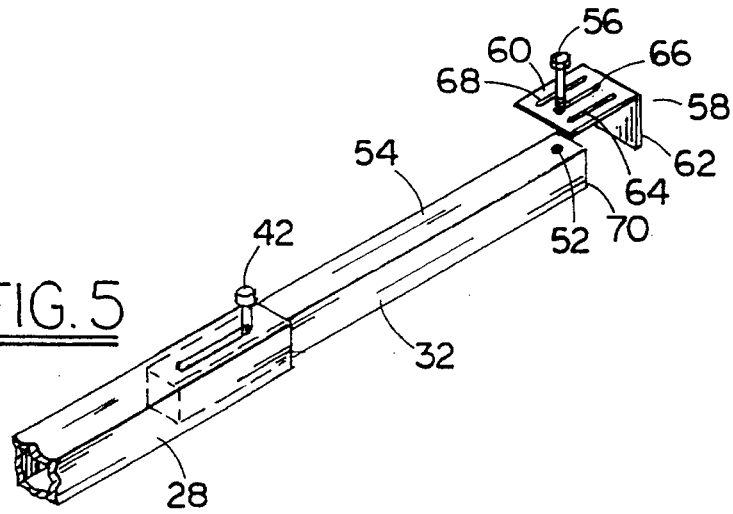
FIG. 5 is a partial side view of the outrigger of FIG. 3 connected to a preferred outrigger mounting bracket.

Referring to FIG. 5, it will be seen that adjustable arm 32 is slidable within tube 28. Thus, referring again to FIG. 3, the outrigger 20 contains means for adjusting its total length 36.

Referring again to FIG. 3, and in the preferred embodiment illustrated therein, it will be seen that the top wall 38 contains a slot 40 through which a fastener 42 may be passed and use to fasten adjustable arm 32. In another embodiment, not shown, the top wall 38 contains a threaded orifice through which a threaded fastener may be inserted and tightened until it locks the adjustable arm 32 into place. In either embodiment, the outrigger arm 20 is comprised of means for releasably and adjustably locking arm 32 into place after it is placed at its desired length.

Referring again to FIG. 3, tube 38 also has attached to it a bracket 44 with fingers 46 and 48, each of which are adapted to fit into a corresponding slotted brace 50. A similar type of adjustable arm bracket is illustrated on page 411 of the January, 1993 Lozier catalog.

As is known to those skilled in the art, slotted brace assemblies 50 are commonly parts of gondola shelving units 12. After adjusting the length of outrigger arm 20, and fastening arm 32 into its desired position within tube 28, bracket 44 may be snapped into that portion of brace 50 which will produce the desired height for outrigger arm 20. Alternatively, one may snap tube assembly 38 into the brace 50 and, thereafter, lock adjustable arm 32 within tube 28 at its desired length.

Referring to FIGS. 3 and 5, it will be seen that adjustable arm 32 is comprised of an orifice 52 disposed in the top surface 54 of adjustable arm 32 through which a fastener 56 may be passed and used to secure outrigger mounting bracket 58. As will be described hereinafter, the outrigger mounting bracket 58 may be used to secure a cornice panel to the outrigger arm 20 at various heights.

Referring again to FIG. 5, it will be seen that outrigger mounting bracket 58 is a substantially L-shaped structure comprised of top wall 60 and font wall 62.

The top wall 60 of outrigger mounting bracket 58 is comprised of horizontally-extending slots 64, 66, and 68. By choosing where one of these slots is positioned over orifice 52, one can adjust the effective length of outrigger arm 20.

As indicated elsewhere in this specification, the primary means of adjusting the length of outrigger 20 is to position adjustable arm 32 within tube 28 and, when the desired position has been achieved, securing the two parts together by means of fastener 42. Thereafter the remainder of the gondola canopy 10 may be assembled and attached to gondola shelving unit 12. The gondola shelving unit may then be loaded with merchandise 14.

Once gondola shelving unit 12 has been loaded with merchandise 14, slidable arm 32 is often less accessible. Thus, outrigger mounting bracket 58 furnishes a second means for adjusting the effective length of outrigger 20. By choosing at what point within slot 64 or 66 or 68 the fastener 56 is to be inserted, one also chooses to what extent, if any, outrigger mounting bracket 58 will extend beyond point 70 of outrigger 20.

FIGS. 7 and 8 are perspective views of outrigger arms 20 which differ from the embodiment depicted in FIGS. 3 and 5 in that the fastener 42 is disposed in an orifice (not shown) in the bottom wall (not shown) of tube 28 rather than its top wall. Referring to FIG. 7, prior to tightening fastener 42, adjustable arm 32 may be moved in the direction of either arrow 76 or arrow 78 to either increase or decrease the effective length of outrigger 20. Thereafter, once merchandise 14 has been loaded onto gondola shelving unit 12, fastener 56 may be loosened, bracket 58 may be moved in the direction of either arrow 80 or arrow 82 to increase or decrease the effective length of outrigger 20, and fastener 20 may be tightened again.

Figure 6:
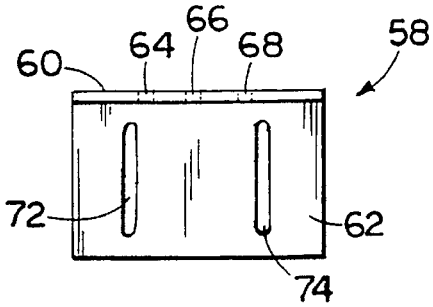
FIG. 6 is a front view of the outrigger mounting bracket of FIG. 5.

As indicated above, once the gondola shelving unit 12 has been loaded with merchandise, it may also be necessary to adjust the height of cornice outrigger plate 18. Such height adjusting means is provided by vertically-extending slots 72 and 74 which are disposed on the front face 62 of outrigger mounting bracket 58 (see FIG. 6). These vertically-extending slots allow one to adjust the height at which cornice outrigger plate 18 is attached to outrigger mounting bracket 58.

As will be seen by reference to FIGS. 7 and 9, cornice outrigger plate 18 is preferably an integral structure comprised of front wall 84 and, attached thereto, horizontally-extending bolts 86 and 88. Referring to FIG. 7, bolt 88 may be inserted through slot 72 and secured by nut 90, and bolt 86 may be inserted through slot 74 (not shown in FIG. 7) and secured with a comparable nut (not shown). Prior to the time such nuts are tightened, the height of cornice outrigger plate 18 may be increased or decreased by moving it in the direction of arrow 92 or arrow 94 and thereafter tightening the nuts.

Referring again to FIG. 9, cornice outrigger plate 18 is comprised of a lip 96 adapted to be removably attached within a slot (not shown) in cornice panel 16 (not shown). In one embodiment, not shown, lip 96 has a substantially arcuate shape. In another embodiment, illustrated in FIG. 9, lip 96 is defined by two substantially linear walls. In another embodiment, not shown, lip 96 is defined by one substantially linear wall, and one substantially arcuate wall.

In the preferred embodiment illustrated in FIG. 9, lip 96 is defined by upwardly extending wall 98 and downwardly extending wall 100. The angle 102 between wall 98 and wall 100 is preferably from about 105 to about 165 degrees.

In the embodiment illustrated in FIG. 9, orifices 104 and 106 extend through wall 100 and/or 102. Screws or other fasteners may be inserted through these orifices and used to prevent the sliding motion of cornice outrigger plate 18 once such plate has been attached to the cornice panel 16.

Referring again to FIG. 9, it will be seen that cornice outrigger plate 18 also is comprised of a slot 108 which, as will be illustrated later in this specification, facilitates the attachment of cornice outrigger plate 18 to the cornice panel 16 (not shown in FIG. 7).

Figure 10:
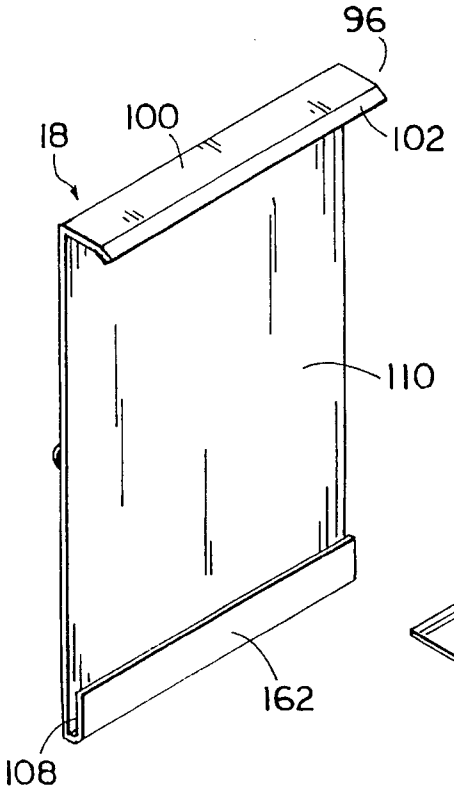
FIG. 10 is a back view of the cornice outrigger plate of FIG. 7.

FIG. 10 is a back view of cornice outrigger plate 18 illustrating how, in this embodiment, slot 108 and lip 96 are preferably integrally formed with back wall 110 of plate 18.

Figure 12:
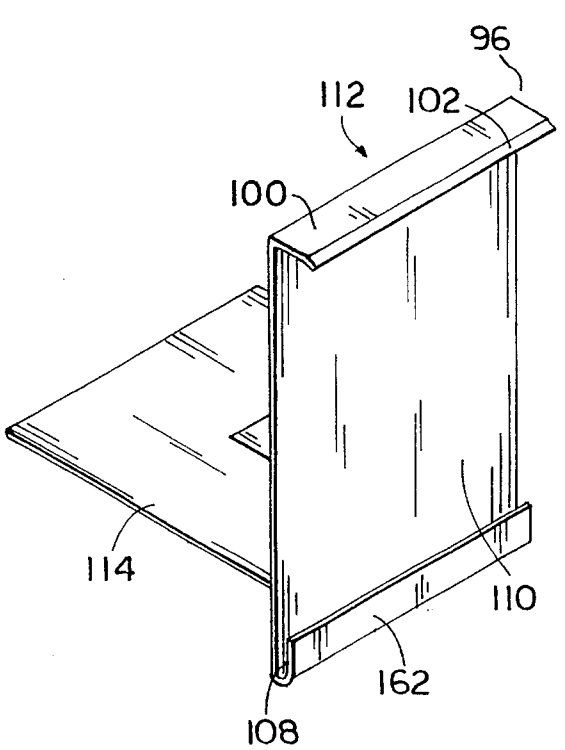
FIG. 12 is a back view of the cornice end plate of FIG. 11.
Figure 11:
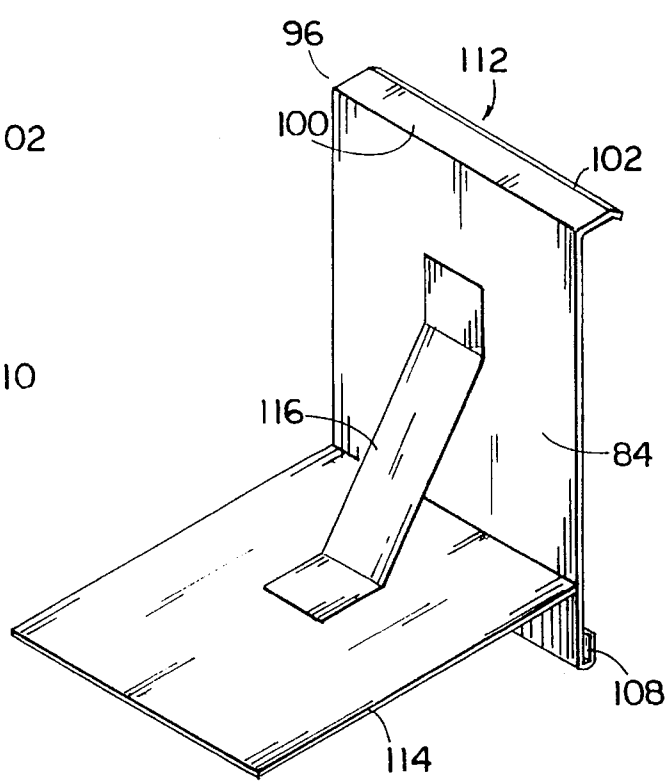
FIG. 11 is a front view of a cornice end plate.

FIGS. 11 and 12 are front and back views, respectively, of cornice end plate 112. In the preferred embodiment of cornice end plate 112 illustrated in these figures, such end plate is comprised of a lip 96, a slot 108, and a back wall 110 which are similar in shape and configuration to the lip 96, slot 108, and back wall 110 of cornice outrigger plate 18. In another embodiment, not shown, one or more of lip 96 and/or slot 108 and/or back wall 110 differ in size and/or shape and/or configuration from one or more of the corresponding lips and/or slots and/or back walls of cornice outrigger plate 18.

In the preferred embodiment illustrated in FIGS. 11 and 12, cornice end plate 112 has substantially the same size and configuration as cornice outrigger plate 18 with the exceptions that (1) it does not comprise either of bolts 86 and 88, and (2) it contains a horizontally extending ledge 114 attached to and extending from front wall 84. As will be discussed later in this specification, this ledge 114 may be used to support a light fixture (not shown) disposed within the gondola canopy unit 10.

In the preferred embodiment illustrated in FIGS. 11 and 12, a brace 116 extends between back wall 84 and ledge 114 to support and strengthen such ledge brace 114.

Figure 13:
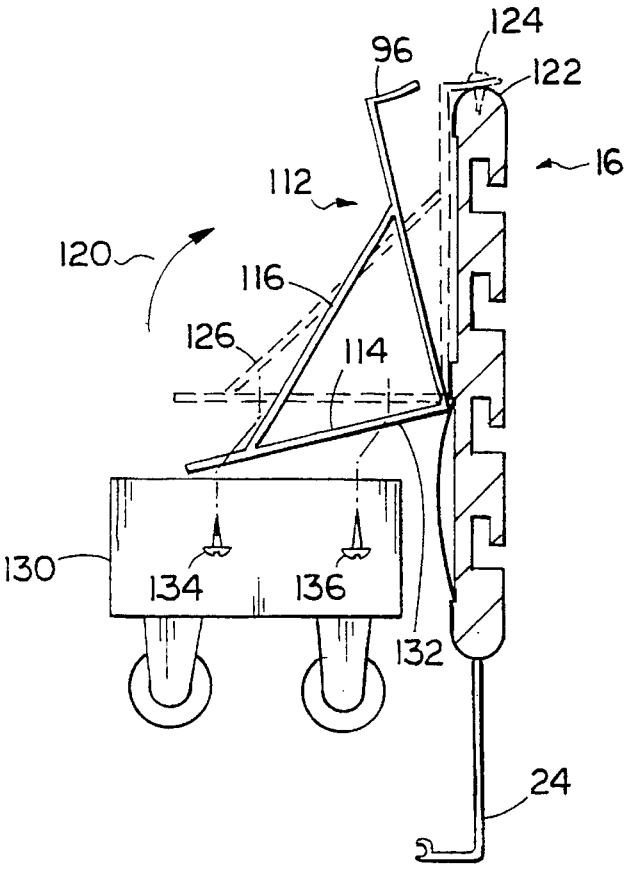
FIG. 13 is a side view illustrating how a light bracket may be attached to the bottom of the cornice end plate of FIG. 11.

FIG. 13 illustrates one means of attaching one embodiment of cornice end plate 112 to cornice panel 16. In this embodiment, upwardly extending slot 108 of cornice end plate 112 (shown in better detail in FIGS. 11 and 12) is interlocked with downwardly-extending lip 118 (shown in better detail in FIG. 18) and rotated in the direction of arrow 120 until lip 96 is contiguous with the top 122, after which it may be secured with a screw 124 (if necessary) to top 122 of cornice panel 16. The position of cornice end plate 112 after it has been rotated in the direction of arrow 120 is shown in dotted lines 126.

In another embodiment, not shown, lip 96 has a configuration similar to the one illustrated in FIG. 11, and the top 122 of cornice panel 16 is comprised of a slot 128 (not shown in FIG. 13, but see FIG. 18) into which wall 100 of lip 96 is inserted.

In another embodiment, not shown, cornice outrigger plate 18 is attached to cornice panel 16 in substantially the same manner as is cornice end plate 112. In this embodiment, it is preferred that the lip 96 and the slot 108 of the cornice end plate 112 be substantially identical in size and shape to the lip 96 and the slot 108 of the cornice outrigger panel 18. It is to be understood, however, that the lips 96 and the slots 108 of the cornice end plate may differ from the corresponding lips 96 and the slots 108 of the cornice outrigger panel. It is also to be understood that more than one cornice end plate 112 and/or cornice outrigger panel 18 may be used in each installation, and these units may (but need not) have one or more of lips 96 and/or slots 108 which differ.

Referring again to FIG. 13, once the cornice end plate is attached to cornice panel 16, as indicated by its dotted line position 126, a light bracket 130 may be attached to the underside 132 of ledge 114 by means of self-tapping screws 134 and 136. As is known to those skilled in the art, many possible arrangements of lights can be accommodated with this apparatus.

Figure 14:
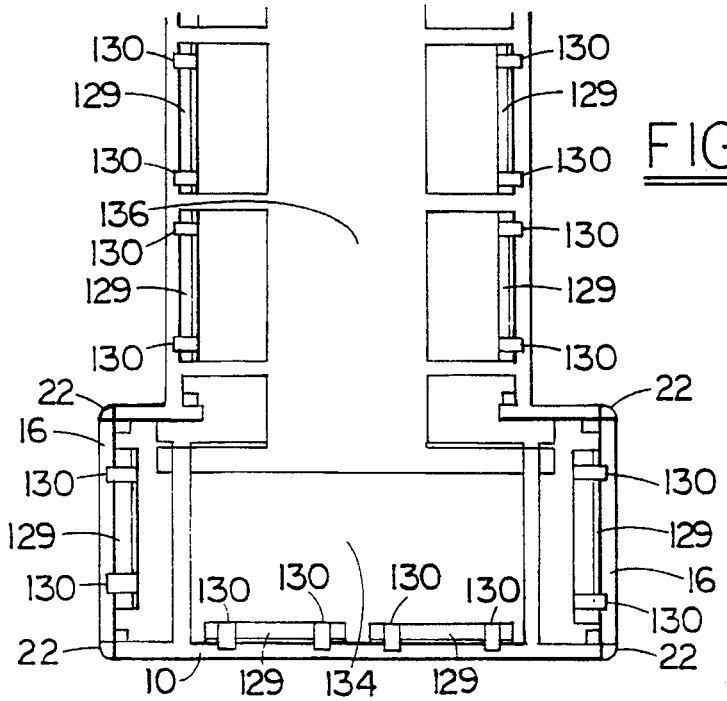
FIG. 14 is a top view of a gondola end out with lights.

One such arrangement is illustrated in FIG. 14, which is a top view showing the gondola end out 134 and a box out end 136. In this embodiment, continuous lights 129 are disposed between light fixture brackets 130.

Figure 15:
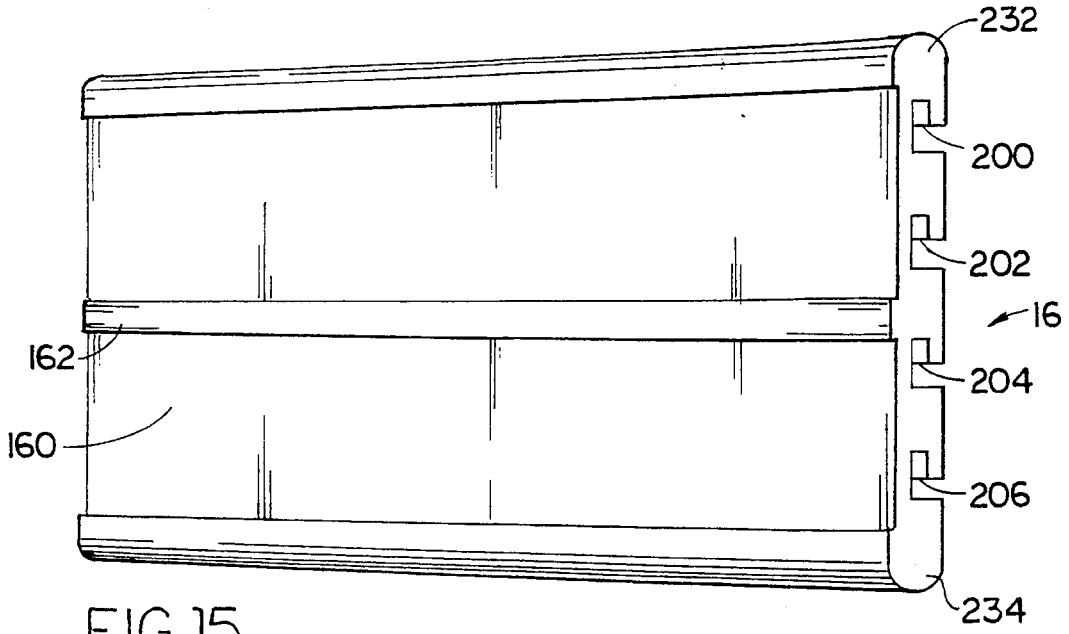
FIG. 15 is a perspective view showing the preferred cornice panel used in applicant's apparatus.
Figure 16:
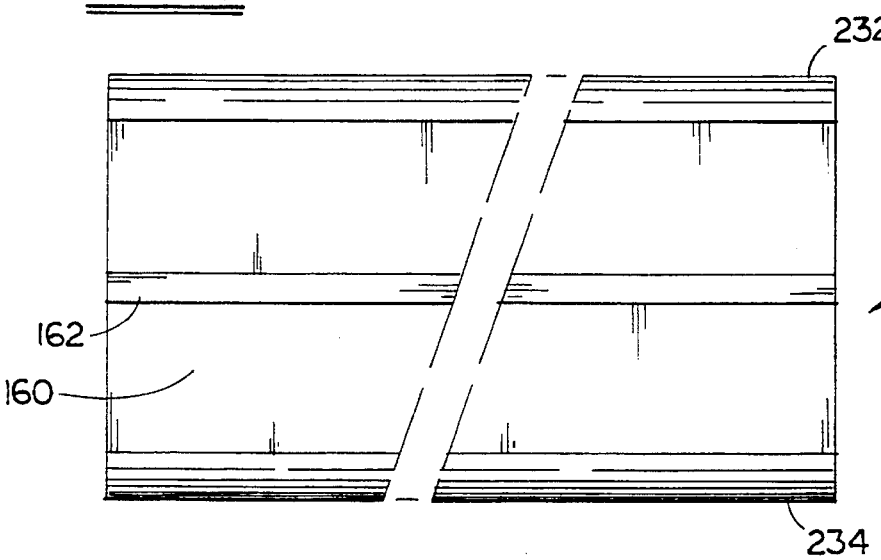
FIG. 16 is a back view of the cornice panel of FIG. 15.

FIG. 15 is a perspective view of one preferred cornice panel 16. Referring to FIG. 15, on face 160 of cornice panel 16 is formed a slot 162 which, in cooperation with slot 108 of either the cornice outrigger panel plate 18 and/or the cornice end plate 112, facilitates the snap-in connection of one or both of such assemblies to cornice panel 16; this snap-in connection is discussed in more detail with regard to FIG. 18.

Figure 17:
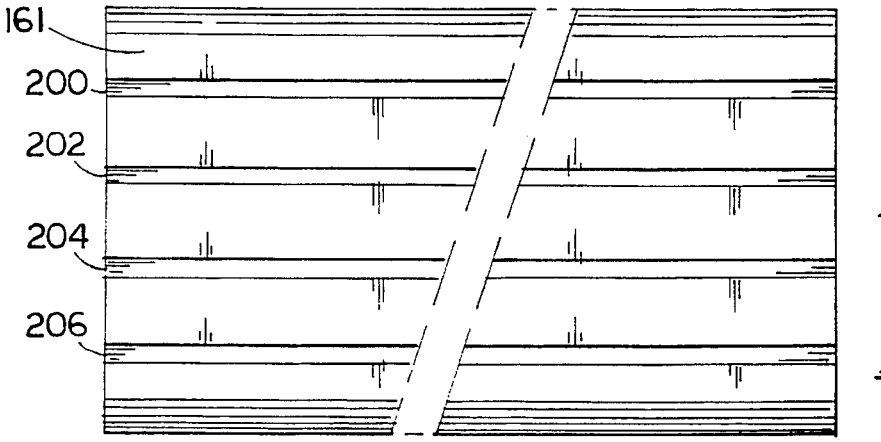
FIG. 17 is a front view of the cornice panel of FIG. 15.

Referring again to FIG. 15, and also to FIG. 17, it will be seen that cornice panel 16 is also comprised of a multiplicity of slots 200, 202, 204, and 206. As is discussed elsewhere in this specification, these slots are adapted to receive pegboard hooks which can be used to display merchandise.

Figure 18:
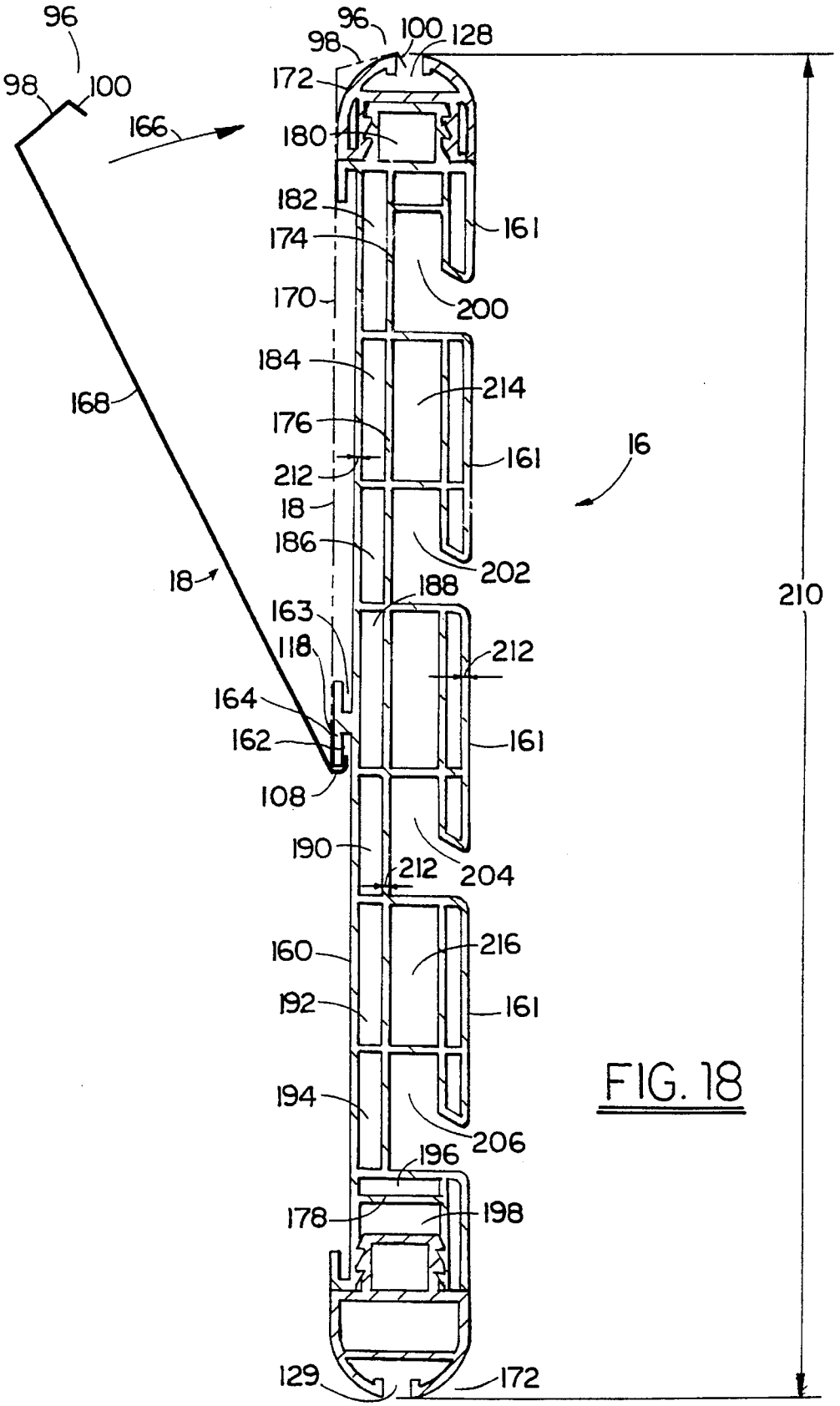
FIG. 18 is a side view of the cornice panel of FIG. 15.

FIG. 18 is a side view of one preferred cornice panel 16 used in the apparatus of this invention. This preferred cornice panel 16 is comprised of means for a hand-insertable snap in connection of either the cornice outrigger plate 18 and/or the cornice end plate 112. Once either of said subassemblies is so snap-in assembled, it preferably is slidably connected to the cornice panel 16.

Referring to FIG. 18, it is seen that the back face 160 of cornice panel 16 is comprised of a downwardly-extending lip 116. In the first stage of the snap-in assembly, upwardly-extending lip 162 defining slot 108 (see FIGS. 9, 10, and 12) is inserted within slot 164 defined by lip 116 and, thereafter, the cornice outrigger plate 18 is rotated in the direction of arrow 166 from position 168 to position 170. As will be apparent to those skilled in the art, such rotation will cause wall 100 to ride upon arcuate surface 172 and, thereafter, snap into slot 128.

The cornice end plate 112 preferably has a structure which is similar to that of cornice outrigger plate 18 and, thus, may be snapped into connection to cornice panel 16 in a similar manner. Thus, because slots 162 and 128 preferably extend the entire length of cornice panel 16, more than one of the cornice outrigger plates 18 and/or more than one of the cornice end plates 112 may be attached to cornice plate 16.

Referring again to FIG. 18, it will be seen that one or more cornice outrigger plates 18 and/or one or more cornice end panels 112 may be attached to end 172 of cornice panel 16. In this embodiment, which is not illustrated in the Figure, slots 163 and 129 are used instead of slots 162 and 128.

In either case, the cornice outrigger plate(s) 18 and/or the cornice end plate(s) 112, once so attached, are slidably connected to cornice panel 16. They may be slidably moved within either slots 162 and 128, or 163 and 129, depending upon whether they are connected to the top or the bottom of the cornice panel 16. This is an important feature. Because of this slidable connection, the material of which the panel 16 is comprised can expand or contract within the slots without changing the alignment of the gondola canopy assembly 10.

Referring again to FIG. 18, it will be seen that cornice panel 16 is comprised of a multiplicity of webs. As is used in this specification, a web is a structural member not making up either the back face 160 or the front face 161 of cornice panel 16 which preferably extends from one end of the cornice panel 16 to the other.

Thus, webs 174, 176, and 178 are some of the webs which cornice panel 16 is comprised of. These webs, which help define a multiplicity of orifices within cornice panel 16 (such as orifices 180, 182, 184, 186, 188, 190, 192, 194, 196, and 198), provide for a lightweight, easily-extrudable structure which has good structural integrity.

Referring again to FIG. 18, it will be seen that the front face 161 of cornice panel 16 is comprised of a multiplicity of slots 200, 202, 204, and 206, which are adapted to receive pegboard hooks (not shown). These pegboard hooks are well known to those skilled in the art and are disclosed, e.g., in U.S. Pat. Nos. 5,080,238, 4,941,632, 4,923,161, 4,917,337, 4,505,856, 4,461,443, 3,664,625, and the like. The disclosure of each of these United States patents is hereby incorporated by reference into this specification.

It is preferred that cornice panel 16 comprise at least two of such slots 200 et seq. for each 8.5 inches of width 210 of cornice panel 16. In a more preferred embodiment, there are at least three such slots 200 for each 8.5 inches of width 210. In the embodiment illustrated in FIG. 18, there are four such slots 200 for each 8.5 inches of width 210.

Referring again to FIG. 18, it will be seen that cornice panel 16 is comprised of a multiplicity of walls defining front face 160, back face 161, and orifices 180–198. It is preferred that all of the walls of cornice panel 16 have substantially the same thickness 212.

Thickness 212 preferably should be at least about 0.035 inches and, more preferably, at least about 0.060 inches. In one embodiment, thickness 212 is from about 0.060 to about 0.125 inches.

It is preferred that cornice panel 16 consist essentially of a plastic material which can readily be extruded. Thus, as is disclosed on pages 156–203 of the fourth edition of Joel Frados' "Plastics Engineering Handbook" (Van Nostrand Reinhold Company, New York, 1976), one may use plastics such as acetal copolymer, acrylonitrile-butadiene-styrene, polycarbonate, polyethylene, nylon 6/6, polyvinyl chloride, and the like.

In one preferred embodiment, polyvinyl chloride is the plastic used to produce cornice panel 16 by extrusion. Extrusion of polyvinyl chloride to produce shaped articles is well known to those skilled in the art and is described, e.g., in U.S. Pat. Nos. 5,102,598, 5,064,908, 5,030,676, 4,978,700, 4,889,897, 4,889,673, 4,846,660, 4,539,124, 3,775,359, 3,696,181, and the like. The disclosure of each of these patents is hereby incorporated by reference into this specification.

In another embodiment, the material used to produce cornice 16 is foamed polyvinyl chloride. These type of foamed materials are well known to those skilled in the art and are described, e.g., in U.S. Pat. Nos. 4,956,396, 4,956,234, 4,886,837, 4,701,472, 4,360,602, 3,709,725, 3,534,134, 3,503,841, and the like. The disclosure of each of these patents is hereby incorporated by reference into this specification.

The preferred cornice panel 16 depicted in FIG. 18 may be joined to other cornice panels 16 in a side-by-side relationship. This is illustrated in FIGS. 19 and 20 in which some of the detail of FIG. 18 (such as, e.g., many of orifices 180–198) have been omitted for the sake of simplicity of representation.

Figure 19:
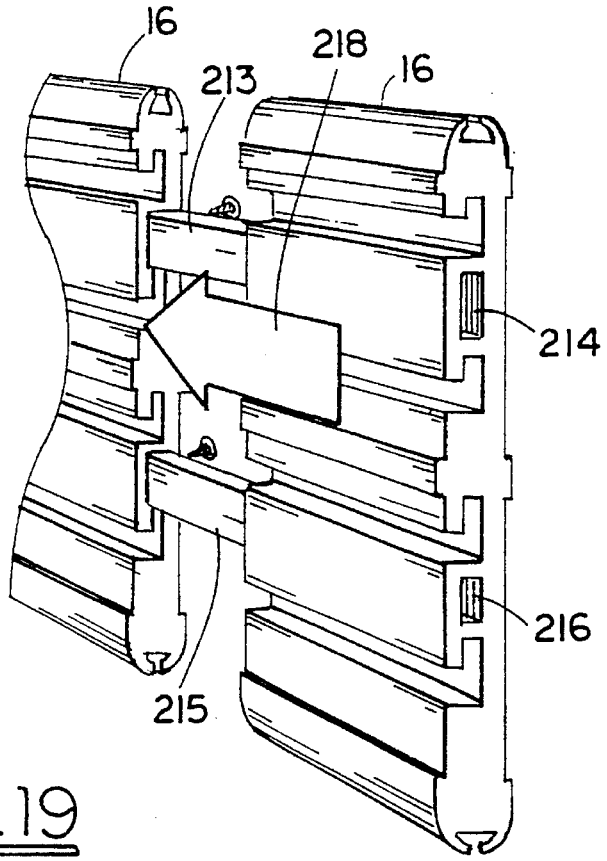
FIG. 19 is an exploded perspective view showing how two of the cornice panels of FIG. 15 may be joined to each other in a side-by-side relationship.
Figure 20:
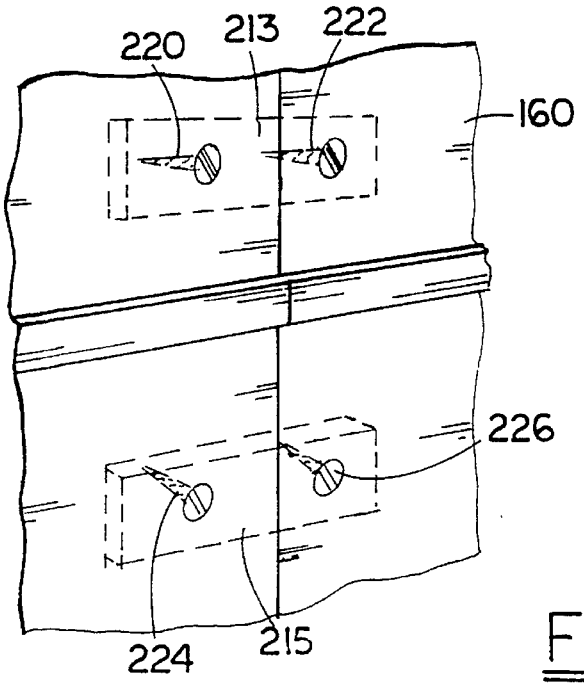
FIG. 20 illustrates how the joined panel structure of FIG. 19 may be secured in their side-by-side relationship.

Referring to FIGS. 19 and 20, wood aligning blocks 213 and 215 may be inserted within slots 214 and 216, adjacent cornice panels 16 may then be pushed towards each other in the direction of arrow 218, and thereafter screws 220, 222, 224, and 226 may be inserted through wall 160 to secure the wood aligning blocks 213 and 215 to the cornice panels 16.

Figure 21:
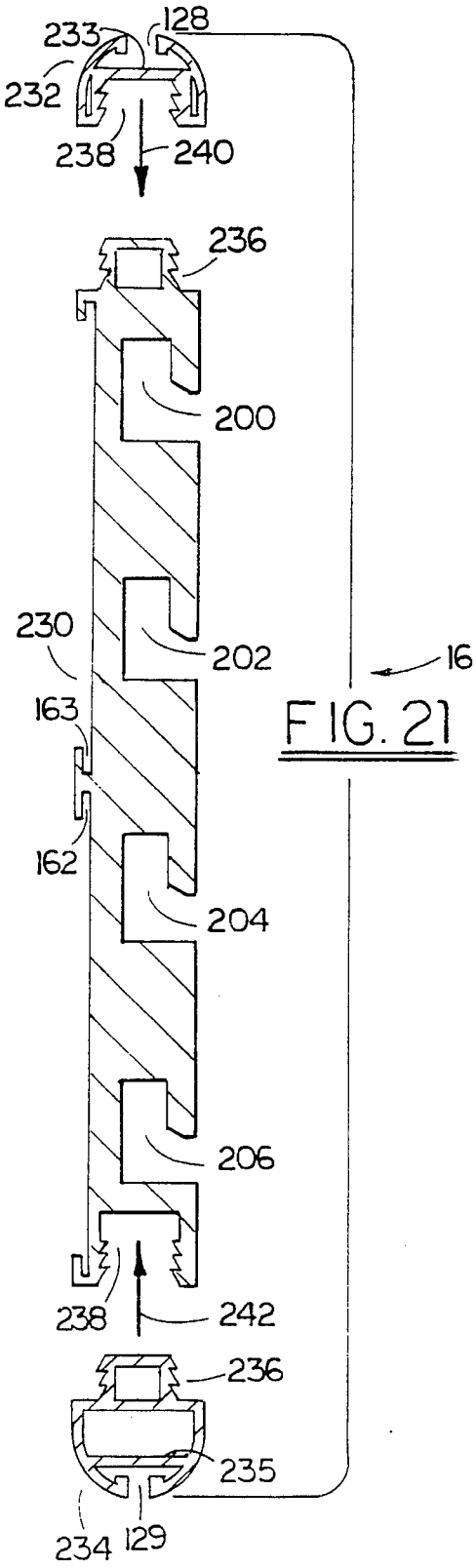
FIG. 21 is an exploded view of the cornice panel of FIG. 13, showing the center panel section being joined to the top panel section and the bottom panel section.

FIG. 21 is an exploded view of a preferred cornice panel 16, illustrating how the center panel section 230 may be joined to top panel section 232 and bottom panel section 234.

As will be seen by reference to FIG. 21, threaded head 236 is adapted to be lockably connected to threaded orifice 238 when head 236 is and orifice 238 are pushed together in the direction of arrow 240 or arrow 242. Once such parts are so joined, they cannot readily be pulled apart. However, since the parts are slidably connected to each other, they may be moved in slidable relationship to each other.

Referring again to FIG. 21, it will be seen that each of the preferred cornice panels 16 illustrated therein contains both a threaded head 236 and a threaded orifice 238. Thus, as will be apparent to those skilled in the art, two or more of such cornice panels 16 may be joined head-to-tail and press-fit together until the desired width is obtained; thereafter, the top panel section 232 may be press-fit on top of the composite structure, and bottom panel section 234 may be press-fit onto the bottom of the composite structure.

FIG. 21 is a perspective view of one preferred diffuser panel which is used in the apparatus of this invention. Diffuser panels are well known to those skilled in the art and are described, e.g., in U.S. Pat. Nos. 5,038,256, 5,034,859, 5,029,339, 4,989,122, 4,941,074, 4,907,142, 4,891,737, 4,833,575, 3,810,168, and the like. The disclosure of each of these patents is hereby incorporated by reference into this specification.

As is known to those skilled in the art, the purpose of a diffuser is to scatter or disperse light emitted from a source, usually by the process of diffuse transmission (transmission accompanied by diffusion or scatter to the extent there is no regular or direct transmission).

Referring to FIG. 24, and in the preferred embodiment illustrated therein, it will be seen that diffuser 24 is comprised of two upwardly and outwardly-extending hooks 250 and 252 adapted to fit within slot 129 of cornice panel 16 (a portion of which is shown in FIG. 25). Diffuser panel 24 also is comprised of means for aligning adjacent diffuser panels 24 with each other. In the preferred embodiment illustrated in FIG. 25, this means is horizontally-extending groove 254.

Referring to FIG. 26, it will be seen that adjacent diffuser panels 24 may be slid into cornice panel 16 within slot 129 by pushing said panels in the direction of arrow 256. Once the diffuser panels 24 have been located in their desired position, rod 258 may be pushed in the direction of arrows 260 and 262 and inserted into groove 254.

Figure 27:
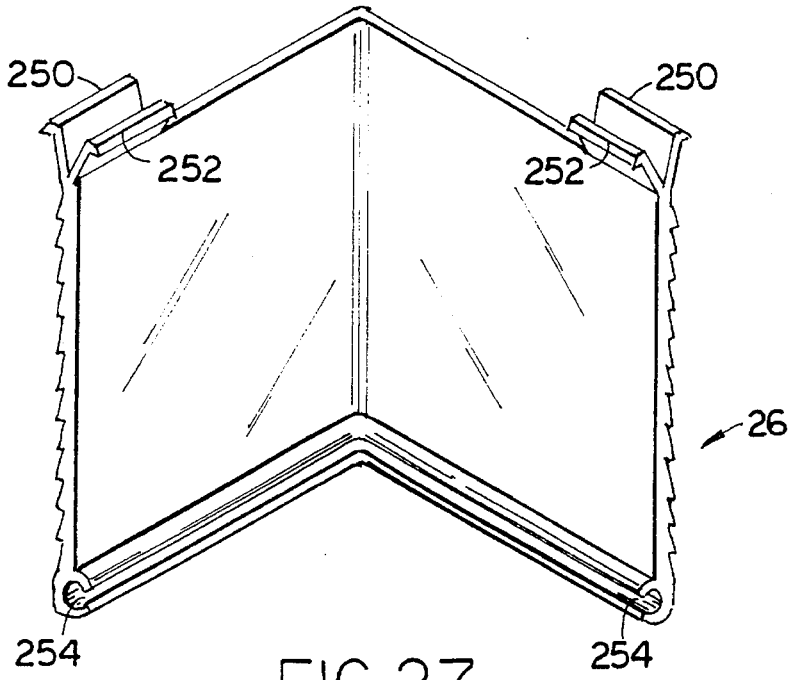
FIG. 27 is a perspective view of an end diffuser panel.

FIG. 27 is a perspective e view of an end diffuser panel 26 which, when used in conjunction with cornice corner insert 22, allows one to produce a composite structure such as, e.g., the one depicted in FIG. 1.

Figure 22:
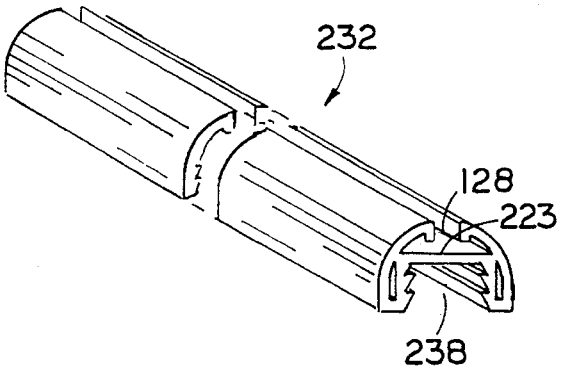
FIG. 22 is a perspective view of the top cap section of FIG. 21.
Figure 28:
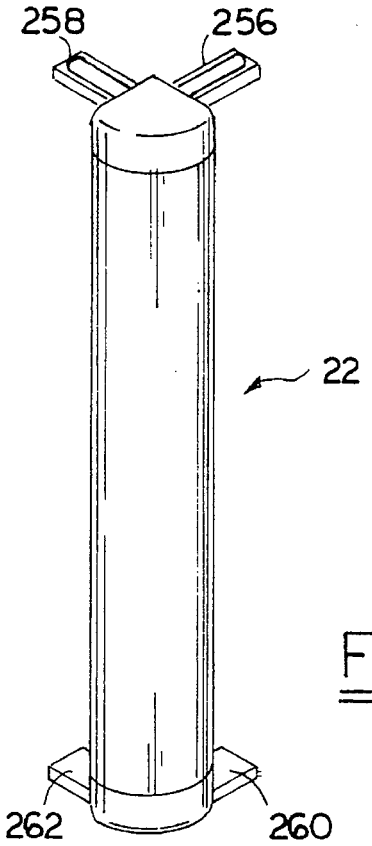
FIG. 28 is a perspective view of a corner insert.

Referring to FIG. 28, it will be seen that cornice corner insert is comprised of two horizontally-extending fingers 256 and 258, each of which extend in directions which are substantially perpendicular to each other. Each of these fingers 256 and 258 is adapted to fit within a slot in an opening within top panel section 232 of cornice panel 16 (see FIG. 22) and to be contiguous with wall 233 of such section 232 (see FIGS. 21 and 22).

Figure 23:
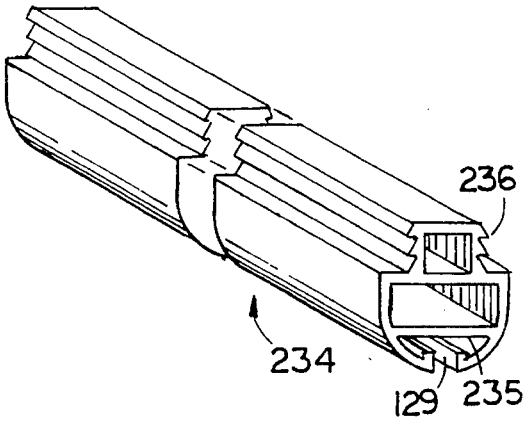
FIG. 23 is a perspective view of the bottom cap section of FIG. 21.

Similarly, and again referring to FIG. 28, it will be seen that cornice corner insert is also comprised of two horizontally-extending fingers 260 and 262, each of which extend in directions which are substantially perpendicular to each other. Each of these fingers 260 and 262 is adapted to fit within a slot in an opening within bottom panel section 234 of cornice panel 16 (see FIG. 23) and to be contiguous with wall 235 of such section 234 (see FIGS. 21 and 23).

Figure 29:
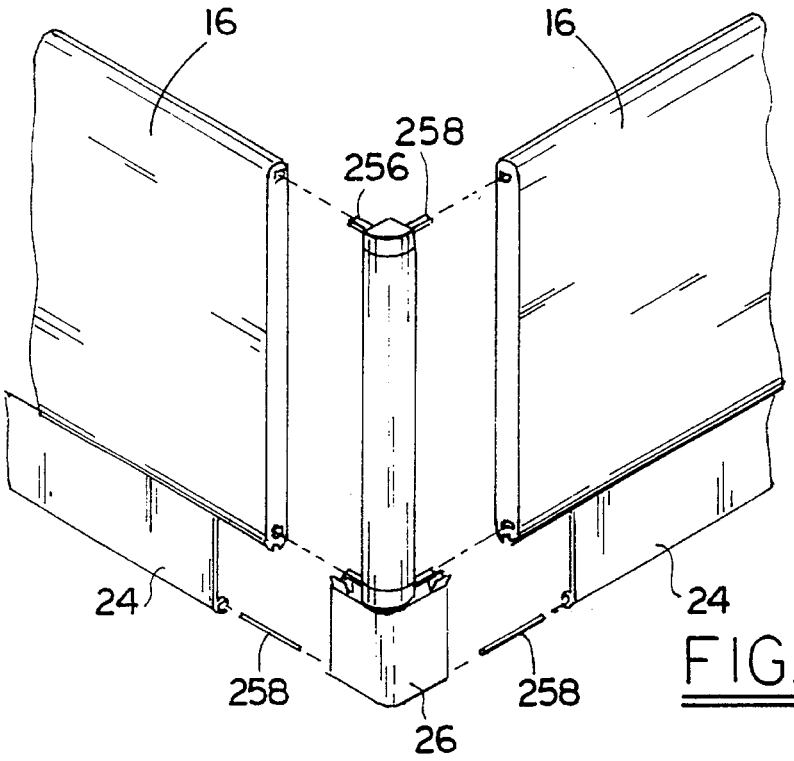
FIG. 29 is an exploded view illustrating how the corner insert of FIG. 27 may be joined to the cornice panel and the end diffuser panel.

FIG. 29 is a perspective view illustrating how two diffuser panels 16 may be joined at substantially right angles to each other.

Figure 30:
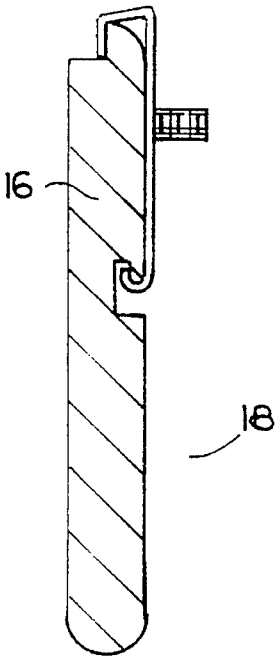
FIGS. 30, 31 and 32 are side views of cornice panel assemblies which indicate alternative means of snap-in connection of a bracket to the cornice panel of FIG. 15.
Figure 31:
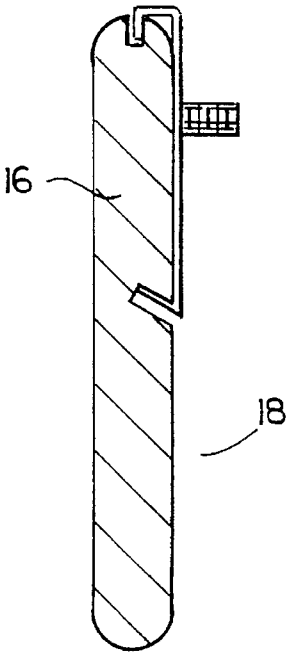
Figure 32:
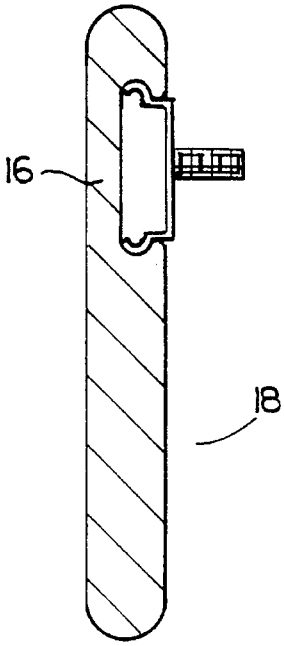

As has been discussed earlier in this specification, FIG. 18 illustrates how either cornice outrigger plate 18 and/or cornice end plate 112 can be pressed into a snap-in engagement with cornice panel 16. As will be apparent to those skilled in the art, the particular combination of walls 100 and 102 and slot 108 cooperating with slots 108 and 128 is not the only means by which either the outrigger plate 18 and/or the cornice end plate 112 can be pressed into slidable engagement with the cornice panel 16. FIGS. 30, 31, and 32 illustrate other possible arrangements utilizing different embodiments of cornice panel 16 and cornice outrigger plate 18; many other such arrangements will be apparent to those skilled in the art.

Figure 33:
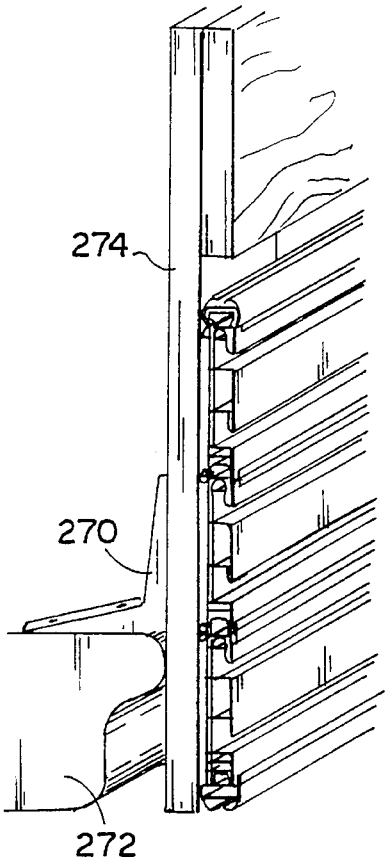
FIG. 33 is a perspective view of a composite panel assembly directly connected to a support surface.
Figure 34:
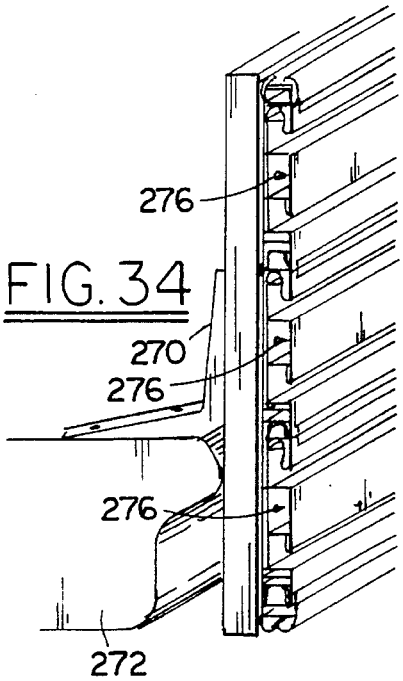
FIG. 34 is a perspective view of a composite panel assembly which illustrates how the assembly of FIG. 33 may be constructed.

The cornice panel 16 of this invention may be connected directly to a wall, as is illustrated in the embodiments depicted in FIGS. 33 and 34. Thus, e.g., referring to FIG. 33, a bracket 270 may be attached, e.g., to the top of a freezer 272 and, also, to a wood slat 274. Wood screws may be inserted through the wood slat 274 to attach the cornice panel 16 directly to the wood slat.

Figure 35:
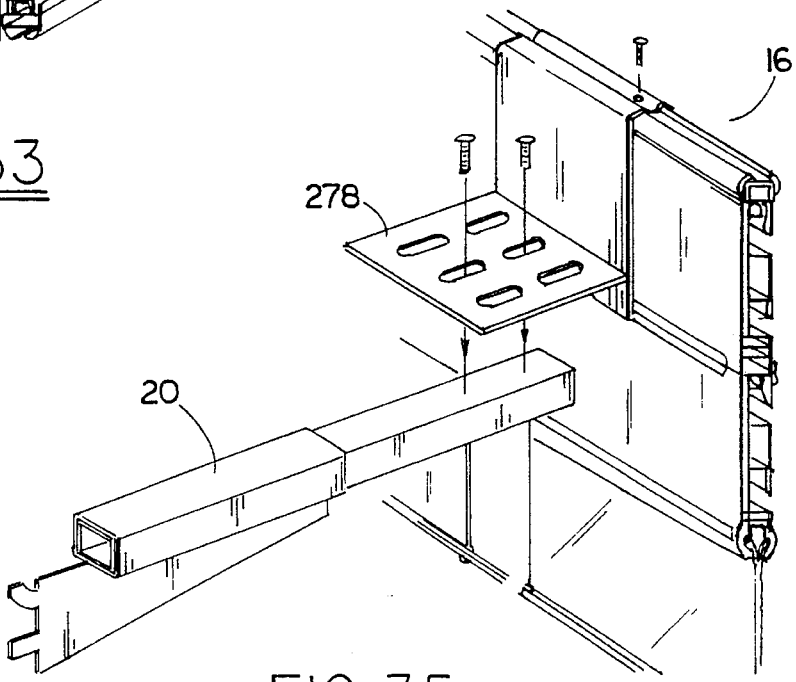
FIG. 35 illustrates an alternative means of attaching the composite panel of FIG. 29 to an outrigger.

In the embodiment depicted in FIG. 35, an outrigger 20 connected directly to a cornice panel 16 by means of a modified plate 208 which is adapted to snap onto the cornice panel 16 in the same manner as cornice outrigger plate 18.

Figure 36:
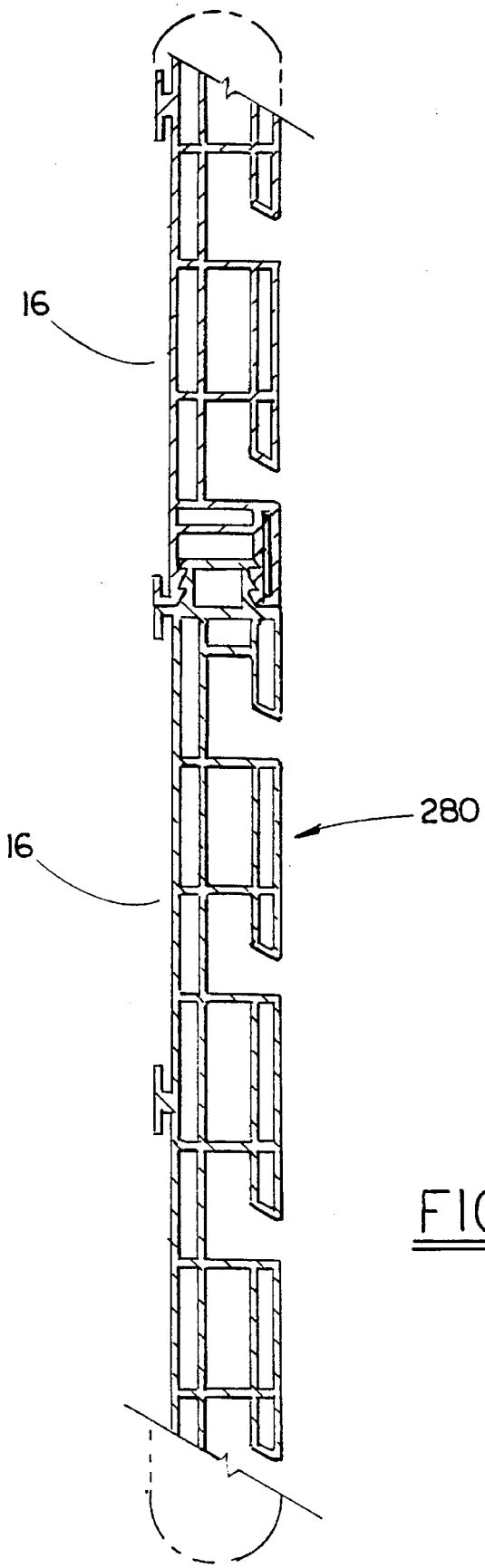
FIG. 36 is a side view of a composite panel assembly which indicates how a multiplicity of panels 15 may be joined top to bottom.

As was discussed elsewhere in this specification, two or more panels 16 may be joined head to tail to produce a composite panel. Such a composite panel is illustrated in FIG. 36.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. An apparatus for constructing a gondola canopy comprising an outrigger arm comprised of means for adjusting the length of said outrigger arm, an adapting plate attached to said outrigger arm, a fascia board removably attached to said adapting plate, means for removably attaching said adapting plate to said fascia board, and means for adjusting the height of said fascia board removably attached to said adapting plate, wherein:

(a) said adapting plate is an integral structure comprised of a first lip and a second lip, (b) said fascia board is comprised of a first slot, a second slot, means for disposing said first lip within said first slot, and means for disposing said second lip within said second slot by pressing said adapting plate against said fascia board;

(c) said fascia board is comprised of a first vertically-extending wall, a second vertically-extending wall, a first horizontaly-extending wall connected to said first vertically-extending wall and said second vertically-extending wall, a second horizontally-extending wall connected to said first vertically-extending wall and said second vertically extending wall, a first chamber defined by said first vertically-extending wall, said second vertically-extending wall, said first horizontally-extending wall, and said second horizontally-extending wall, a third horizontaly-extending wall connected to said first vertically-extending wall and said second vertically-extending wall and a second chamber defined by said said first vertically-extending wall and said second vertically extending wall, said second horizontally-extending wall, and third horizontally-extending wall.

2. The apparatus as recited in claim 1, wherein said outrigger arm is comprised of a slotted angle plate.

3. The apparatus as recited in claim 2, wherein said angle plate is a substantially L-shaped structure comprised of a vertical wall, a horizontal wall, two slots disposed within said vertical wall, and two slots disposed within said horizontal wall.

4. The apparatus as recited in claim 3, wherein said outrigger plate is comprised of a first tubular section disposed within a second tubular section.

5. The apparatus as recited in claim 1, wherein said adaptor plate is connected to a first, horizontally-extending threaded stud, and a second, horizontally-extendng threaded stud.

6. The apparatus as recited in claim 5, wherein said adaptor plate is comprised of a first side, said first lip defined by said first side, a second side, and a third side, and said second lip defined by said first side, a fourth side, a fifth side.

7. The apparatus as recited in claim 1, wherein said second lip of said adaptor plate is comprised of a first orifice.

8. The apparatus as recited in claim 1, wherein said fascia board consists essentially of plastic.

9. An apparatus for constructing a gondola canopy comprising an outrigger arm comprised of means for adjusting the length of said outrigger arm, an adapting plate attached to said outrigger arm, a fascia board removably attached to said adapting plate, means for removably attaching said adapting plate to said fascia board, and means for adjusting the height of said fascia board removably attached to said adapting plate, wherein:

(a) said adapting plate is an integral structure comprised of a first lip and a second lip, and (b) said fascia board is comprised of a first slit, a second slot, means for disposing said first lip within said first slot, and means for disposing said second lip within said second slot by pressing said adapting plate against said fascia board, (c) said fascia board is comprised of a top section comprised of vertically-extending stub comprising a multiplicity of diagonally-extending teeth, (d) said fascia board is comprised of a bottom section comprised of a vertically extending orifice with an interior surface comprising a multiplicity of diagonally-extending teeth.

10. The apparatus as recited in claim 9, wherein said fascia board is comprised of a first vertically-extending wall, a second vertically-extending wall, a first horizontaly-extending wall connected to said first vertically-extending wall and said second vertically-extending wall, a second horizontally-extending wall connected to said first vertically-extending wall and said second vertically extending wall, a first chamber defined by said first vertically-extending wall, said second vertically-extending wall, said first horizontally-extending wall, and said second horizontally-extending wall, a third horizontaly-extending wall connected to said first vertically-extending wall and said second vertically-extending wall, and a second chamber defined by said first vertically-extending wall and said second vertically extending wall, said second horizontally-extending wall, and third horizontally-extending wall.

11. The apparatus as recited in claim 10, wherein said fascia board is comprised of a multiplicity of substantially L-shaped slots extending from said second vertically-extending wall of said fascia board.

12. The apparatus as recited in claim 11, wherein each of said L-shaped slots is comprised of a first chamber.

13. The appratus as recited in claim 12, wherein each of said L-shaped slots is comprised of a second chamber.

14. An apparatus for constructing a gondola canopy comprising an outrigger arm comprised of means for adjusting the length of said outrigger arm, a adapting plate attached to said outrigger arm, a fascia board removably attached to said adapting plate, a light mounting plate adapted to said fascia board, means for removably attaching said adapting plate to said fascia board, means for removably attaching said light mounting plate to said fascia board, and means for adjusting the height of said fascia board removably attached to said adapting plate, wherein:

(a) said adapting plate is an integral structure comprised of a first lip and a second lip, (b) said light mounting plate is an integral structure comprised a horizontally-extending wall, a vertically-extending wall, a third lip attached to said horizontally-extending wall, a fourth lip attached to said horizontally-extending wall, (b) said fascia board is comprised of a first slot, a second slot, means for disposing said first lip within said first slot, and means for disposing said second lip within said second slot by pressing said adapting plate against said fascia board.

15. The apparatus as recited in claim 9, wherein said apparatus further comprises said fascia board is attached to a translucent diffuser element.

16. The apparatus as recited in claim 15, wherein said translucent diffuser element is slidably attached to said fascia board.

17. The apparatus as recited in claim 16, wherein said translucent element is comprised of a slot and a rod disposed within such slot.

18. The apparatus as recited in claim 9, wherein said apparatus is comprised of a corner removably attached thereto, wherein said corner is comprised of a first finger and, disposed substantially perpendicularly thereto, a second finger.

19. The apparatus as recited in claim 9, wherein said fascia board is comprised of a wooden slat disposed within said fascia board.

* * * * *